US011158256B2

(12) United States Patent
Lin et al.

(10) Patent No.: US 11,158,256 B2
(45) Date of Patent: Oct. 26, 2021

(54) METHODS AND APPARATUS FOR MITIGATING CHARGE SETTLING AND LATERAL LEAKAGE CURRENT ON ORGANIC LIGHT-EMITTING DIODE DISPLAYS

(71) Applicant: Apple Inc., Cupertino, CA (US)

(72) Inventors: Chin-Wei Lin, San Jose, CA (US); Fan Gui, San Jose, CA (US); Hung Sheng Lin, San Jose, CA (US); Hyunwoo Nho, Stanford, CA (US); Jie Won Ryu, Campbell, CA (US); Junhua Tan, Santa Clara, CA (US); Kingsuk Brahma, Mountain View, CA (US); Majid Gharghi, San Carlos, CA (US); Mohammad Reza Esmaeili Rad, San Jose, CA (US); Shinya Ono, Cupertino, CA (US); Yun Wang, Cupertino, CA (US); Zino Lee, Gyeonggi-do (KR)

(73) Assignee: Apple Inc., Cupertino, CA (US)

( * ) Notice: Subject to any disclaimer, the term of this patent is extended or adjusted under 35 U.S.C. 154(b) by 74 days.

(21) Appl. No.: 16/762,846

(22) PCT Filed: Sep. 28, 2018

(86) PCT No.: PCT/US2018/053589
§ 371 (c)(1),
(2) Date: May 8, 2020

(87) PCT Pub. No.: WO2019/112683
PCT Pub. Date: Jun. 13, 2019

(65) Prior Publication Data

US 2021/0012712 A1 Jan. 14, 2021

Related U.S. Application Data

(60) Provisional application No. 62/595,390, filed on Dec. 6, 2017.

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2300/0819* (2013.01);
(Continued)

(58) Field of Classification Search
CPC ... G09G 3/3275; G09G 3/3233; G09G 3/3655
(Continued)

(56) References Cited

U.S. PATENT DOCUMENTS 8,913,044 B2 12/2014 Miyazawa
9,351,368 B2 5/2016 Azizi et al.
(Continued)

FOREIGN PATENT DOCUMENTS

JP 2002278513 A 9/2002

*Primary Examiner* — Calvin C Ma
(74) *Attorney, Agent, or Firm* — Treyz Law Group, P.C.; Jason Tsai

(57) ABSTRACT

A display may include an array of organic light-emitting diode display pixels having transistors characterized by threshold voltages subject to transistor variations. Compensation circuitry may be used to sense a current from selected display pixels. A display pixel may include a drive transistor, a gate setting transistor for driving a reference voltage onto the gate terminal of the drive transistor, a data loading and current sensing transistor for connecting the drive transistor to a data/current-sensing line, a light-emitting diode, an emission control transistor coupled between the drive transistor and the diode, and an anode resetting transistor for selectively resetting the anode terminal of the diode. During in-frame current sensing operations, the emission control transistor may be turned off to decouple the drive transistor from the diode, thereby blocking off any residue current and lateral leakage current that may be present at the diode.

20 Claims, 15 Drawing Sheets

(52) U.S. Cl.
CPC ..... *G09G 2310/0213* (2013.01); *G09G 2310/0297* (2013.01); *G09G 2310/08* (2013.01); *G09G 2320/0233* (2013.01)

(58) Field of Classification Search
USPC ..... 345/173, 214
See application file for complete search history.

(56) References Cited

U.S. PATENT DOCUMENTS

| | | | | |
|---|---|---|---|---|
| 9,370,075 | B2 | 6/2016 | Chaji et al. | |
| 9,747,834 | B2 | 8/2017 | Chaji | |
| 2004/0066358 | A1* | 4/2004 | Numao | G09G 3/2011 345/76 |
| 2007/0075939 | A1* | 4/2007 | Cho | G09G 3/3233 345/76 |
| 2010/0045646 | A1 | 2/2010 | Kishi | |
| 2016/0063922 | A1 | 3/2016 | Tsai et al. | |
| 2017/0162113 | A1 | 6/2017 | Lin et al. | |
| 2019/0081261 | A1* | 3/2019 | Lee | C09K 11/08 |
| 2019/0156718 | A1 | 5/2019 | Moradi et al. | |
| 2020/0388225 | A1* | 12/2020 | Kim | G06F 3/0418 |

* cited by examiner

METHODS AND APPARATUS FOR MITIGATING CHARGE SETTLING AND LATERAL LEAKAGE CURRENT ON ORGANIC LIGHT-EMITTING DIODE DISPLAYS

This application claims priority to U.S. patent application No. 62/595,390, filed on Dec. 6, 2017, which is hereby incorporated by reference herein in its entirety.

BACKGROUND

This relates generally to electronic devices with displays and, more particularly, to display driver circuitry for displays such as organic-light-emitting diode displays.

Electronic devices often include displays. For example, cellular telephones and portable computers include displays for presenting information to users.

Displays such as organic light-emitting diode displays have an array of display pixels based on light-emitting diodes. In this type of display, each display pixel includes a light-emitting diode and thin-film transistors for controlling application of a signal to the light-emitting diode to produce light.

An organic light-emitting diode display pixel includes a drive thin-film transistor connected to a data line via an access thin-film transistor. The access transistor may have a gate terminal that receives a scan signal via a corresponding scan line Image data on the data line can be loaded into the display pixel by asserting the scan signal to turn on the access transistor. The display pixel includes a current source transistor that provides current to the organic light-emitting diode to produce light.

Transistors in an organic light-emitting diode display pixel may be subject to process, voltage, and temperature (PVT) variations. Due to such variations, transistor threshold voltages between different display pixels may vary. Variations in transistor threshold voltages can cause the display pixels to produce amounts of light that do not match a desired image. Compensation schemes are sometimes used to compensate for variations in threshold voltage. Such compensation schemes typically involve sampling operations that are performed within each pixel during normal display operations and thus increase the time required to display images.

It is within this context that the embodiments herein arise.

SUMMARY

An electronic device may include a display having an array of display pixels. The display pixels may be organic light-emitting diode display pixels. Each display pixel may have an organic light-emitting diode that emits light. A drive transistor (i.e., a current source transistor) in each display pixel may apply current to the organic light-emitting diode in that display pixel. The drive transistor may be characterized by a threshold voltage that is subject to random variations. Compensation circuitry may be used to measure sensing current from the drive transistor, to compare the sensing current to a predetermined current level, and to apply external compensation to the display pixel based on the comparison.

The display pixel may include a drive transistor, a gate setting transistor configured to drive the gate terminal of the drive transistor to a known reference voltage level, a data loading transistor for loading emission data into the display pixel and for outputting sensing current to the compensation circuitry, an organic light-emitting diode coupled in series with the drive transistor, an emission control transistor interposed between the drive transistor and the diode, and an anode reset transistor for resetting the anode terminal of the diode. The emission control transistor may be turned off during current sensing operations so that residue current and lateral leakage current at the organic light-emitting diode are prevented from contributing to the sensing current, thereby increasing the integrity of the external compensation operations (e.g., the emission control transistor is configured to electrically isolate and decouple any parasitic effects of the diode from the current sensing path).

In one suitable arrangement, a first portion of the transistors in the display pixel are semi-conducting oxide transistor to reduce leakage, whereas a second portion of the transistors in the display pixel are silicon transistors to increase performance. In another suitable arrangement, all of the transistors in the display pixel are semiconducting-oxide transistors to minimize power consumption. In one implementation, the emission control transistor and the anode reset transistor may be controlled using the same emission control signal. In another implementation, the anode reset transistor is controlled by a separate scan control signal that is different than the emission control signal.

DETAILED DESCRIPTION

Figure 1:
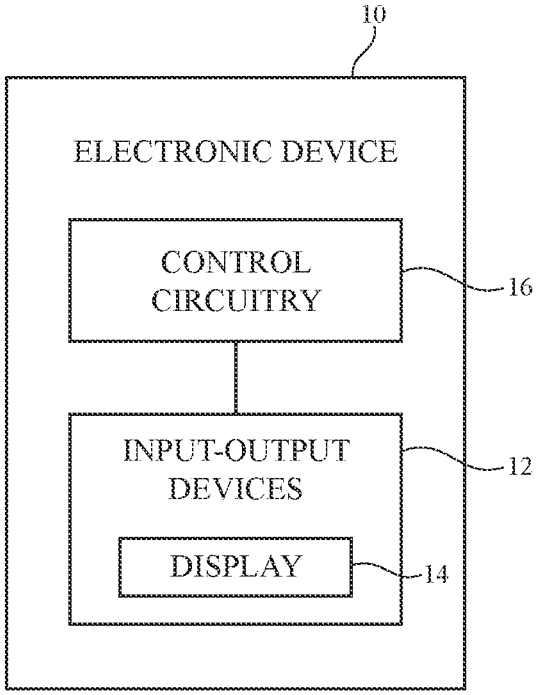
FIG. 1 is a diagram of an illustrative electronic device having a display in accordance with an embodiment.

An illustrative electronic device of the type that may be provided with an organic light-emitting diode (OLED) display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid-state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio codec chips, application specific integrated circuits, programmable integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14 in input-output devices.

Figure 2:
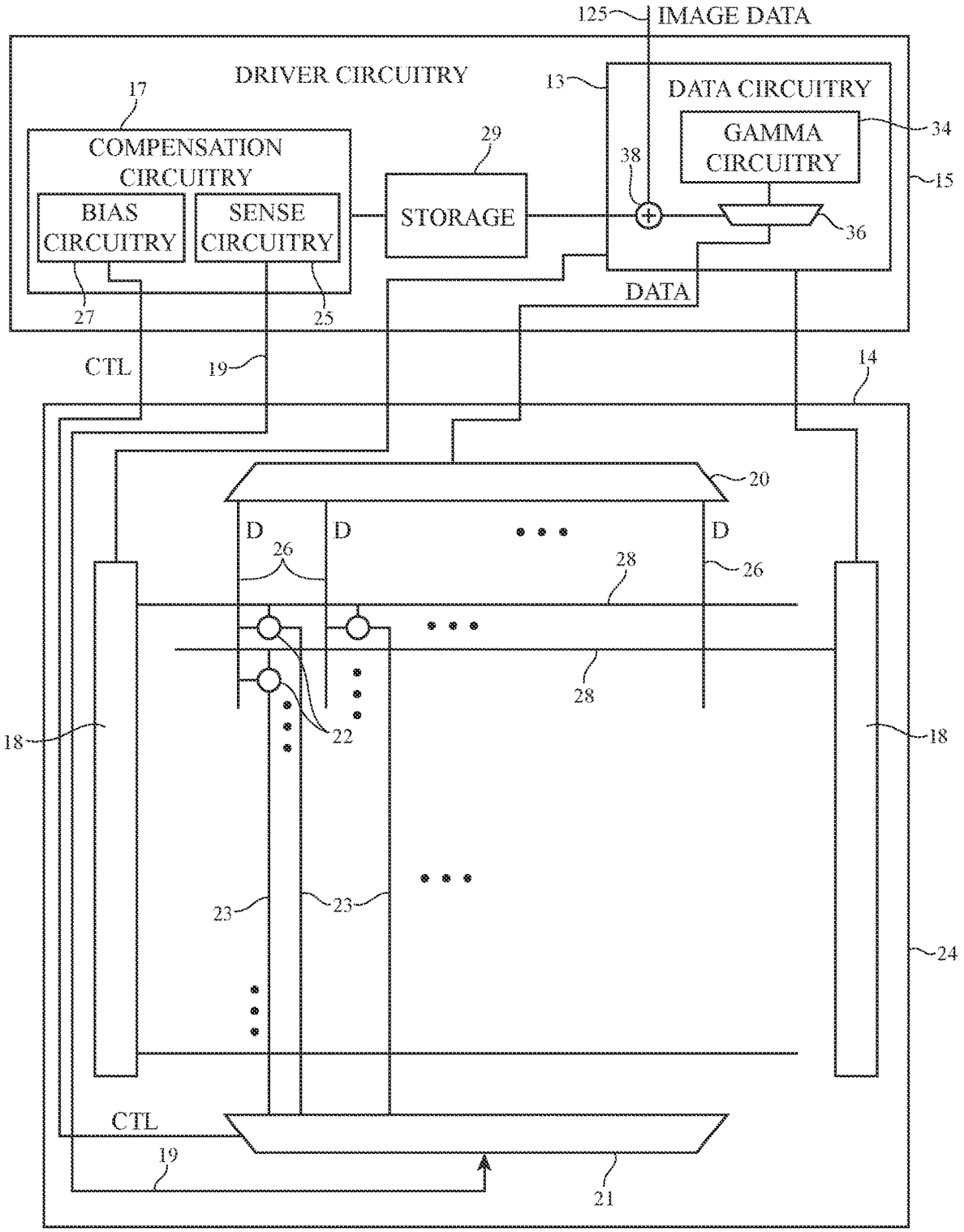
FIG. 2 is a diagram of an illustrative display having an array of organic light-emitting diode display pixels coupled to compensation circuitry in accordance with an embodiment.

FIG. 2 shows display 14 and associated display driver circuitry 15. Display 14 includes structures formed on one or more layers such as substrate 24. Layers such as substrate 24 may be formed from planar rectangular layers of material such as planar glass layers. Display 14 may have an array of display pixels 22 for displaying images to a user. The array of display pixels 22 may be formed from rows and columns of display pixel structures on substrate 24. These structures may include thin-film transistors such as polysilicon thin-film transistors, semiconducting oxide thin-film transistors, etc. There may be any suitable number of rows and columns in the array of display pixels 22 (e.g., ten or more, one hundred or more, or one thousand or more).

Display driver circuitry such as display driver integrated circuit 15 may be coupled to conductive paths such as metal traces on substrate 24 using solder or conductive adhesive. If desired, display driver integrated circuit 15 may be coupled to substrate 24 over a path such as a flexible printed circuit or other cable. Display driver integrated circuit 15 (sometimes referred to as a timing controller chip) may contain communications circuitry for communicating with system control circuitry 16 over path 125. Path 125 may be formed from traces on a flexible printed circuit or other cable. Control circuitry 16 (see FIG. 1) may be located on a main logic board in an electronic device such as a cellular telephone, computer, television, set-top box, media player, portable electronic device, or other electronic equipment in which display 14 is being used.

During operation, the control circuitry may supply display driver integrated circuit 15 with information on images to be displayed on display 14. To display the images on display pixels 22, display driver integrated circuit 15 may supply clock signals and other control signals to display driver circuitry such as row driver circuitry 18 and column driver circuitry 20. For example, data circuitry 17 may receive image data and process the image data to provide pixel data signals to display 14. The pixel data signals may be demultiplexed by column driver circuitry 20 and pixel data signals D may be routed to each pixel 22 over data lines 26 (e.g., to each red, green, or blue pixel). Row driver circuitry 18 and/or column driver circuitry 20 may be formed from one or more integrated circuits and/or one or more thin-film transistor circuits.

Display driver integrated circuit 15 may include compensation circuitry 17 that helps to compensate for variations among display pixels 22 such as threshold voltage variations. Compensation circuitry 17 may, if desired, also help compensate for transistor aging. Compensation circuitry 17 may be coupled to pixels 22 via path 19, switching circuitry 21, and paths 23. Compensation circuitry 17 may include sense circuitry 25 and bias circuitry 27. Sense circuitry 25 may be used in sensing (e.g., sampling) voltages from pixels 22. During sense operations, switching circuitry 21 may be configured to electrically couple sense circuitry 25 to one or more selected pixels 22. For example, compensation circuitry 17 may produce control signal CTL to configure switching circuitry 21. Sense circuitry 25 may sample voltages such as threshold voltages or other desired signals from the pixels over path 19, switching circuitry 21, and paths 23. Bias circuitry 27 may include one or more driver circuits for driving reference or bias voltages onto nodes of pixels 22. For example, switching circuitry 21 may be configured to electrically couple path 19 to one or more selected pixels 22. In this scenario, bias circuitry 27 may provide reference signals to the selected pixels. The reference signals may bias nodes at the selected pixels at desired voltages for the sensing operations performed by sense circuitry 25.

Compensation circuitry 17 may perform compensation operations on pixels 22 using bias circuitry 27 and sense circuitry 25 to generate compensation data that is stored in storage 29. Storage 29 may, for example, be static random-access memory (SRAM). In the example of FIG. 2, storage 29 is on-chip storage. If desired, storage 29 may be off-chip storage such as non-volatile storage (e.g., non-volatile memory that maintains stored information even when the display is powered off). The compensation data stored in storage 29 may be retrieved by data circuitry 13 during display operations. Data circuitry 13 may process the compensation data along with incoming digital image data to generate compensated data signals for pixels 22.

Data circuitry 13 may include gamma circuitry 34 that provides a mapping of digital image data to analog data signals at appropriate voltage levels for driving pixels 22. Multiplexer 36 receives a set of possible analog data signals from gamma circuitry 34 and is controlled by the digital image data to select an appropriate analog data signal for the digital image data. Compensation data retrieved from storage 29 may be added to (or subtracted from) the digital image data by adder circuit 38 to help compensate for transistor variations (e.g., threshold voltage variations, transistor aging variations, or other types of variations) between different display pixels 22. This example in which compensation data is added as an offset to digital input image data is merely illustrative. In general, data circuitry 13 may process compensation data along with image data to produce compensated analog data signals for driving pixels 22.

In contrast to techniques that focus on performing in-pixel threshold canceling (such as by performing a reset phase followed by a threshold compensation phase), performing sensing and compensation in this way using compensation circuitry 17 outside of each pixel 22 allows for higher refresh rates (e.g., greater than 60 Hz refresh rate, at least 120 Hz refresh rate, etc.) and is sometimes referred to as "external" compensation. External variation compensation may be performed in the factory, in real time (e.g., during blanking intervals between successive image frames), or when the display is idle (as examples).

Row driver circuitry 18 may be located on the left and right edges of display 14, on only a single edge of display 14, or elsewhere in display 14. During operation, row driver circuitry 18 may provide row control signals on horizontal lines 28 (sometimes referred to as row lines, "scan" lines, and/or "emission" lines). Row driver circuitry may include scan line driver circuitry for driving the scan lines and emission driver circuitry for driving the emission lines.

Demultiplexing circuitry 20 may be used to provide data signals D from display driver integrated circuit (DIC) 15 onto a plurality of corresponding vertical lines 26. Demultiplexing circuitry 20 may sometimes be referred to as column driver circuitry, data line driver circuitry, or source driver circuitry. Vertical lines 26 are sometimes referred to as data lines. During display operations, display data may be loaded into display pixels 22 using lines 26.

Each data line 26 is associated with a respective column of display pixels 22. Sets of horizontal signal lines 28 run horizontally through display 14. Each set of horizontal signal lines 28 is associated with a respective row of display pixels 22. The number of horizontal signal lines in each row is determined by the number of transistors in the display pixels 22 that are being controlled independently by the horizontal signal lines. Display pixels of different configurations may be operated by different numbers of scan lines.

Row driver circuitry 18 may assert control signals such as scan and emission signals on the row lines 28 in display 14. For example, driver circuitry 18 may receive clock signals and other control signals from display driver integrated circuit 15 and may, in response to the received signals, assert scan control signals and an emission control signal in each row of display pixels 22. Rows of display pixels 22 may be processed in sequence, with processing for each frame of image data starting at the top of the array of display pixels and ending at the bottom of the array (as an example). While the scan lines in a row are being asserted, control signals and data signals that are provided to column driver circuitry 20 by DIC 15 may direct column driver circuitry 20 to demultiplex and drive associated data signals D (e.g., compensated data signals provided by data circuitry 13) onto data lines 26 so that the display pixels in the row will be programmed with the display data appearing on the data lines D. The display pixels can then display the loaded display data.

Figure 3:
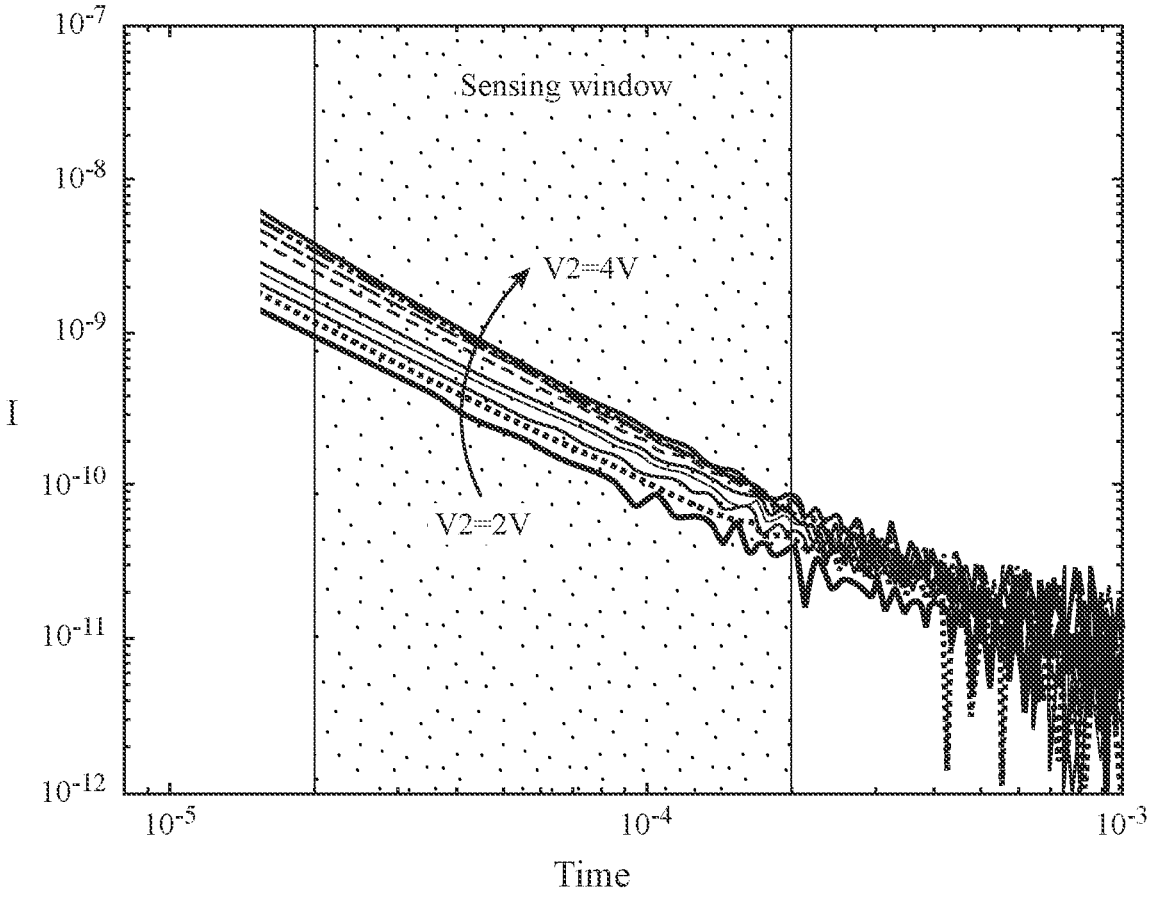
FIG. 3 is a plot illustrating residue current after an organic light-emitting diode has been turned off.

The sensing operation performed by sense circuitry 25 may involve sensing current from selected display pixels. In particular, sense circuitry 25 may be configured to measure current from the organic light-emitting diode of a selected display pixel. FIG. 3 is a plot showing how there may be residue current that remains after an organic light-emitting diode is turned off. The residue current is due to trapped charge at the anode terminal of the diode. As shown in FIG. 3, the residue current may continue to vary over time even after the diode is shut off. Moreover, the current levels are dependent on the voltage level that is present at the anode of the diode prior to turning off the diode. As a result, the residue current from the previous image frame can negatively affect the accuracy of the current sensing operations, which will degrade the capability of compensation circuitry 17 to externally compensate for pixel-to-pixel variations.

Figure 4:
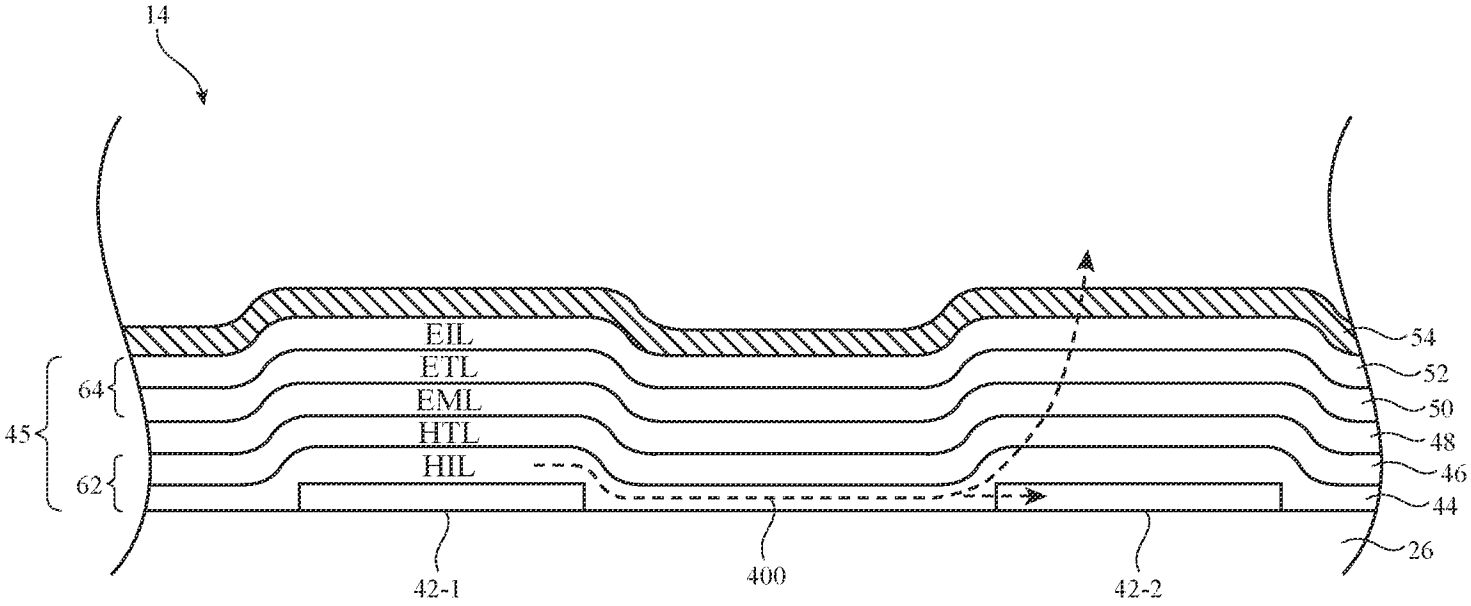
FIG. 4 is a cross-sectional view of a display illustrating lateral leakage current between anode terminals of two adjacent organic light-emitting diodes.

Another issue that negatively impacts the accuracy of current sensing operations is lateral leakage current between anode terminals of adjacent organic light-emitting diodes. FIG. 4 is a cross-sectional view of a display illustrating lateral leakage current between two adjacent organic light-emitting diodes. As shown in FIG. 4, OLED layers 45 (sometimes referred to as an organic stack-up, an organic stack, or an organic light-emitting diode (OLED) stack) may include a hole injection layer (HIL) 44, a hole transport layer (HTL) 46, an emissive layer (EML) 48, an electron transport layer (ETL) 50, and an electronic injection layer (EIL) 52 interposed between anodes 42 and cathode 54. The hole injection layer and hole transport layer may collectively be referred to as a hole layer (i.e., hole layer 62). The electron transport layer and the electron injection layer may collectively be referred to as an electron layer (i.e., electron layer 64). Emissive layer 48 may include organic electroluminescent material. As shown, hole layer 62 and electron layer 64 may be blanket (common) layers that cover the entire array.

Ideally, adjacent diodes in display 14 operate independently. In practice, the presence of common layers such as hole layer 62 present an opportunity for leakage current from one diode to flow laterally into an adjacent diode, thereby potentially disrupting the adjacent diode. For example, there is a possibility that the process of applying a drive current between anode 42-1 and cathode 54 will give rise to lateral leakage current through hole layer 62 (e.g., a current from anode 42-1 to anode 42-2), as indicated by leakage current path 400.

The examples of layers included between the anodes 42 and the cathode 54 in FIG. 4 are merely illustrative. If desired, additional layers may be included between anodes 42 and cathode 54 (i.e., an electron blocking layer, a charge generation layer, a hole blocking layer, etc.). In general, any desired layers may be included in between the anodes and the cathode and any layer that is formed across the display may be considered a common laterally conductive layer. Each layer in OLED layers 45 may be formed from any desired material. In some embodiments, the layers may be formed from organic material. However, in some cases one or more layers may be formed from inorganic material or a material doped with organic or inorganic dopants.

In the example of FIG. 4, a patterned anode layer is formed below a common cathode layer. This example is merely illustrative. If desired, the organic light-emitting diode may be inverted such that the cathode is patterned per-pixel and the anode is a common layer. In this case, the order of the OLED layers in organic stack 45 may be inverted as well. For example, the electron injection layer may be formed on a patterned cathode, the electron transport layer may be formed on the electron injection layer, the emissive layer may be formed on the electron transport layer, the hole transport layer may be formed on the emissive layer, the hole injection layer may be formed on the hole transport layer, and a common anode layer may be formed on the hole injection layer.

Figure 5:
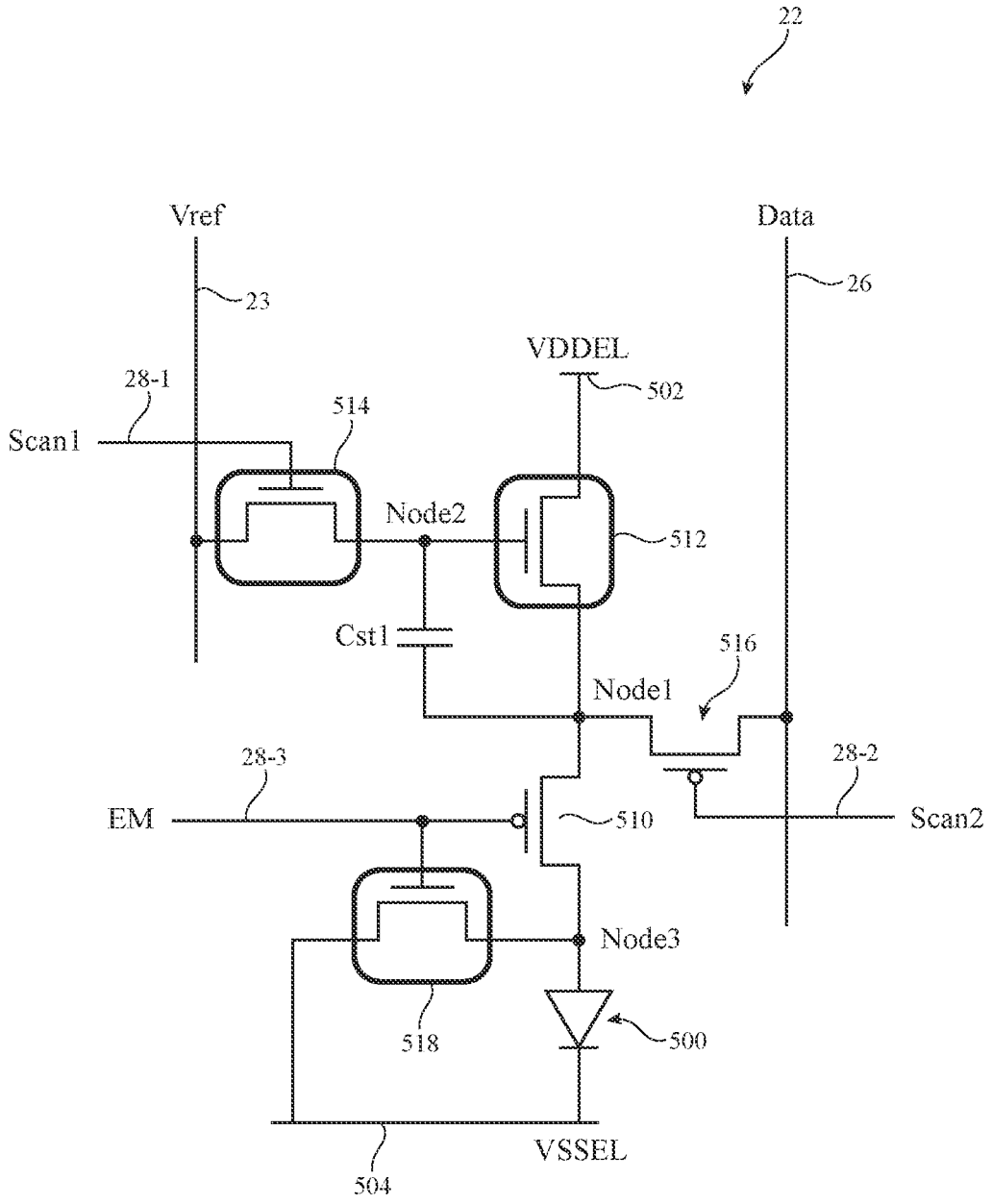
FIG. 5 is a circuit diagram of an illustrative display pixel in accordance with an embodiment.

In accordance with an embodiment, a display pixel 22 that is configured to mitigate both the residue current and the lateral leakage current issues during current sensing operations is shown in FIG. 5. As shown in FIG. 5, display pixel 22 may include a light-emitting diode 500, n-channel thin-film transistors 512, 514, and 518, p-channel thin-film transistors 510 and 516, and a storage capacitor Cst1. In particular, transistor 512 is sometimes referred to as the "drive" transistor. Transistors 510 and 512 and diode 500 may be coupled in series between a first power supply line 502 (e.g., a positive power supply line on which positive power supply voltage VDDEL is provided) and a second power supply line 504 (e.g., a ground power supply line on which ground voltage VSSEL is provided). Transistor 510 has a gate terminal that receives an emission control signal EM provided over emission control line 28-3. Transistor 510 is therefore sometimes referred to as an emission control transistor. Storage capacitor Cst1 may have first and second terminals that are coupled to gate and source terminals of drive transistor 512, respectively.

Transistor 514 may be coupled between column line 23 (e.g., a shared path on which a reference voltage Vref is provided to each pixel 22 along a given column) and the gate of drive transistor 512. The gate terminal of drive transistor 512 is marked as Node2 in FIG. 5. Transistor 514 has a gate terminal that receives scan control signal SCAN1 via first scan control line 28-1 and is selectively turned on to set the gate voltage of drive transistor 512 to a predetermined voltage level (e.g., to voltage level Vref). Transistor 514 is therefore sometimes referred to as a gate voltage setting transistor.

Transistor 516 may be coupled between column line 26 (e.g., a data line that is coupled to column driver circuitry 20) and the source terminal of drive transistor 512. Transistor 516 has a gate terminal that receives scan control signal SCAN2 via second scan control line 28-2 and is selectively turned on to load a data signal into pixel 22. Transistor 516 is therefore sometimes referred to as a data loading transistor.

Transistor 518 may have a gate terminal that receives emission control signal EM, a drain terminal that is coupled to the anode terminal of diode 500 (marked as Node3 in FIG. 5), and a source terminal that is coupled to ground line 504. Configured in this way, transistor 518 may be coupled in parallel with diode 500 and may be selectively activated using signal EM to drive Node3 down to voltage VSSEL. Transistor 518 is therefore sometimes referred to as an anode resetting transistor.

In the arrangement of FIG. 5, not only is data loading performed using line 26, but current sensing can also be performed on data line 26. In other words, sensing circuitry 25 of compensation circuitry 17 shown in FIG. 2 might share the same data lines 26 with the data programming circuitry. If data programming and current sensing were not performed on the same data line 26, it will be necessary to include a separate sensing path for each pixel column (i.e., line 23 will need to also support current sensing), which would substantially increase array routing complexity and area. Thus, performing data programming and current sensing via data lines 26 can help dramatically reduce array routing complexity and area, because a global reference voltage line 23 can be coupled to each pixel column (e.g., reference line 23 might be shared among the different columns in the display pixel array).

Current sensing therefore requires turning on the data loading transistor. In conventional display pixels, the data/sensing line would typically be electrically connected to the anode terminal of the light-emitting diode. In such cases, the residue current from the previous frame and lateral leakage current from an adjacent pixel will affect the current that is sensed through the data loading transistor. By interposing emission control transistor 510 between the current sensing node (i.e., Node1) and the anode terminal of diode 500 (i.e., Node3), the current sensing node is decoupled from diode 500 during current sensing operations (e.g., by turning off drive transistor 510 during current sensing operations). In other words, the problems illustrated in FIGS. 3 and 4 can be solved by electrically isolating diode 500 from the rest of display pixel 22 during current sensing operations (e.g., by deactivating a transistor such as transistor 510 that connects Node1 to Node3).

With one suitable arrangement, which is sometimes described herein as an example, the channel region (active region) in some thin-film transistors on display 14 is formed from silicon (e.g., silicon such as polysilicon deposited using a low temperature process, sometimes referred to as "LTPS" or low-temperature polysilicon), whereas the channel region in other thin-film transistors on display 14 is formed from a semiconducting oxide material (e.g., amorphous indium gallium zinc oxide, sometimes referred to as "IGZO"). If desired, other types of semiconductors may be used in forming the thin-film transistors such as amorphous silicon, semiconducting oxides other than IGZO, etc. In a hybrid display configuration of this type, silicon transistors (e.g., LTPS transistors) may be used where attributes such as switching speed and good drive current are desired (e.g., for gate drivers in liquid crystal diode displays or in portions of an organic light-emitting diode display pixel where switching speed is a consideration), whereas oxide transistors (e.g., IGZO transistors) may be used where low leakage current is desired (e.g., in liquid crystal diode display pixels and display driver circuitry) or where high pixel-to-pixel uniformity is desired (e.g., in an array of organic light-emitting diode display pixels). Other considerations may also be taken into account (e.g., considerations related to power consumption, real estate consumption, hysteresis, etc.). Oxide transistors such as IGZO thin-film transistors are generally n-channel devices (i.e., NMOS transistors). Silicon transistors can be fabricated using p-channel or n-channel designs (i.e., LTPS devices may be either PMOS or NMOS). Combinations of these thin-film transistor structures can provide optimum performance.

In the example of FIG. 5, transistor 512, 514, and 518 may be semiconducting-oxide transistors, while the other transistors 510 and 516 are silicon transistors (e.g., p-channel LTPS transistors). Since the impedance at the gate of drive transistor 512 is high, implementing drive transistor 512 and gate setting transistor 514 as semi-conducting oxide transistors is advantageous to help reduce leakage and power consumption. If desired, other combinations of silicon and/or oxide transistors can be used in the five-transistor configuration of FIG. 5.

Figure 6:
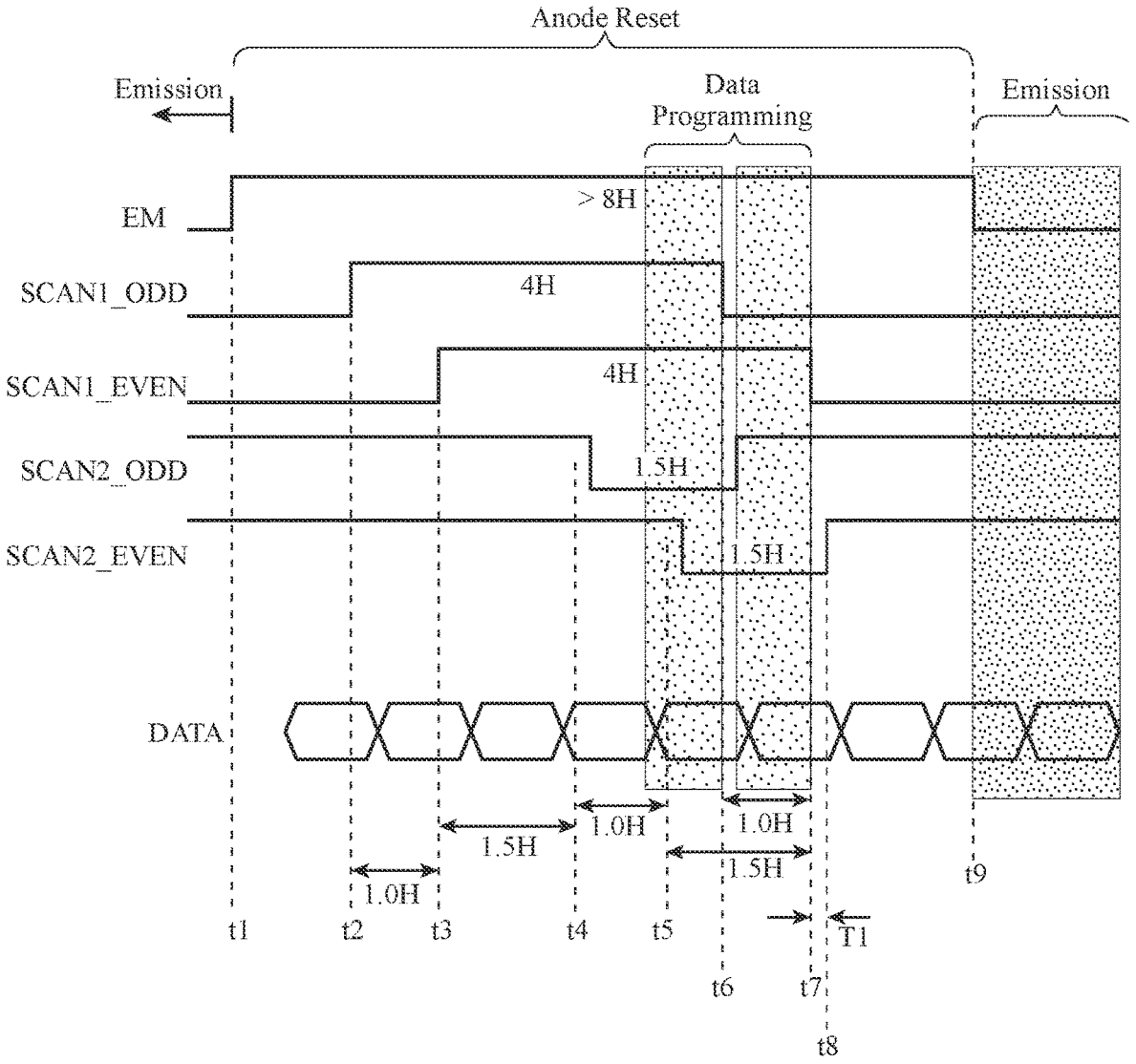
FIG. 6 is a timing diagram illustrating relevant waveforms when operating the display pixel shown in FIG. 5 in accordance with an embodiment.

FIG. 6 is a timing diagram illustrating relevant waveforms in operating display pixel 22 of FIG. 5. In the example of FIG. 6, at least one of the row control lines can be shared between pixels in adjacent rows. For example, signal EM may be shared between two adjacent rows (e.g., between a first odd row and a second even row), whereas signals SCAN1_ODD and SCAN2_ODD are separately fed to an odd row of pixels and while signals SCAN1_EVEN and SCAN2_EVEN are separately fed to an even row of pixels.

Since emission control transistor 510 is a p-channel transistor, the associated emission control signal EM is an active-low signal. In other words, p-channel transistor 510 is turned on by asserting signal EM (i.e., by driving EM low) and is turned off by deasserting signal EM (i.e., by driving EM high). Prior to time t1, only signal EM is asserted (e.g., active-low emission control signal EM is driven low to logic "0") while all other scan control signals are deasserted (e.g., the SCAN1 active-high signals are driven to logic "0" while the SCAN2 active-low signals are driven to logic "1"). The period during which signal EM is asserted may be referred to as the emission period or the emission phase. At time t1, signal EM is deasserted to turn off emission control transistor 510. Since signal EM also controls anode reset transistor 518, driving signal EM high at time t1 turns on transistor 518 and resets Node3 to ground voltage VSSEL. The entire time period during which EM is driven high (i.e., from time t1 to t9) may therefore sometimes be referred to as an anode reset period/phase.

At time t2, scan signal SCAN1_ODD may be asserted to turn on transistor 514 in the odd row. Since transistor 514 is an n-channel transistor, signal SCAN1 controlling transistor 514 is an active-high signal (i.e., asserting SCAN1 drives SCAN1 to logic "1"). Activating transistor 514 in the odd row may allow the gate of the corresponding drive transistor 512 to be set to the reference voltage level Vref. At time t3, scan signal SCAN1_EVEN may be asserted to turn on transistor 514 in the even row. Activating transistor 514 in the even row may allow the gate of the corresponding drive transistor 512 to be set to the reference voltage level Vref.

At time t4, scan signal SCAN2_ODD may be asserted to turn on transistor 516 in the odd row. Since transistor 516 is an p-channel transistor, signal SCAN2 controlling transistor 516 is an active-low signal (i.e., asserting SCAN2 drives SCAN2 to logic "0"). Activating transistor 516 in the odd row may allow a data signal presented along line 26 to be loaded into the corresponding display pixel (e.g., the data signal may be loaded onto Node1). The value of the data signal at the falling edge of signal SCAN2_ODD (at around time t6) determines what is actually loaded into the display pixel. The period of time during which data is loaded into pixel 22 may be referred to as the data programming period or the data writing phase. The duration of time that the data signal should be held constant for that row is indicated as one unit programming time 1.0 H.

At time t5, scan signal SCAN2_EVEN may be asserted to turn on transistor 516 in the even row. Activating transistor 516 in the even row may allow a data signal presented along line 26 to be loaded into the corresponding display pixel. The value of the data signal at the falling edge of signal SCAN2_EVEN (at around time t8) determines what is actually loaded into the display pixel.

Signal SCAN2_ODD may be deasserted (i.e., driven high) right after time t6, which ends the data programming phase for the odd row. Signal SCAN2_EVEN may be deasserted (i.e., driven high) at time t8, which ends the data programming phase for the even row. At time t9, signal EM is driven low to resume the emission period. During the emission phase, current will flow through transistors 510 and 512 and light-emitting diode 500, where the magnitude of the current is dependent on the voltage stored across capacitor Cst1. The amount of current will affect the actual luminance of light that is emitted from diode 500.

Figure 7A:
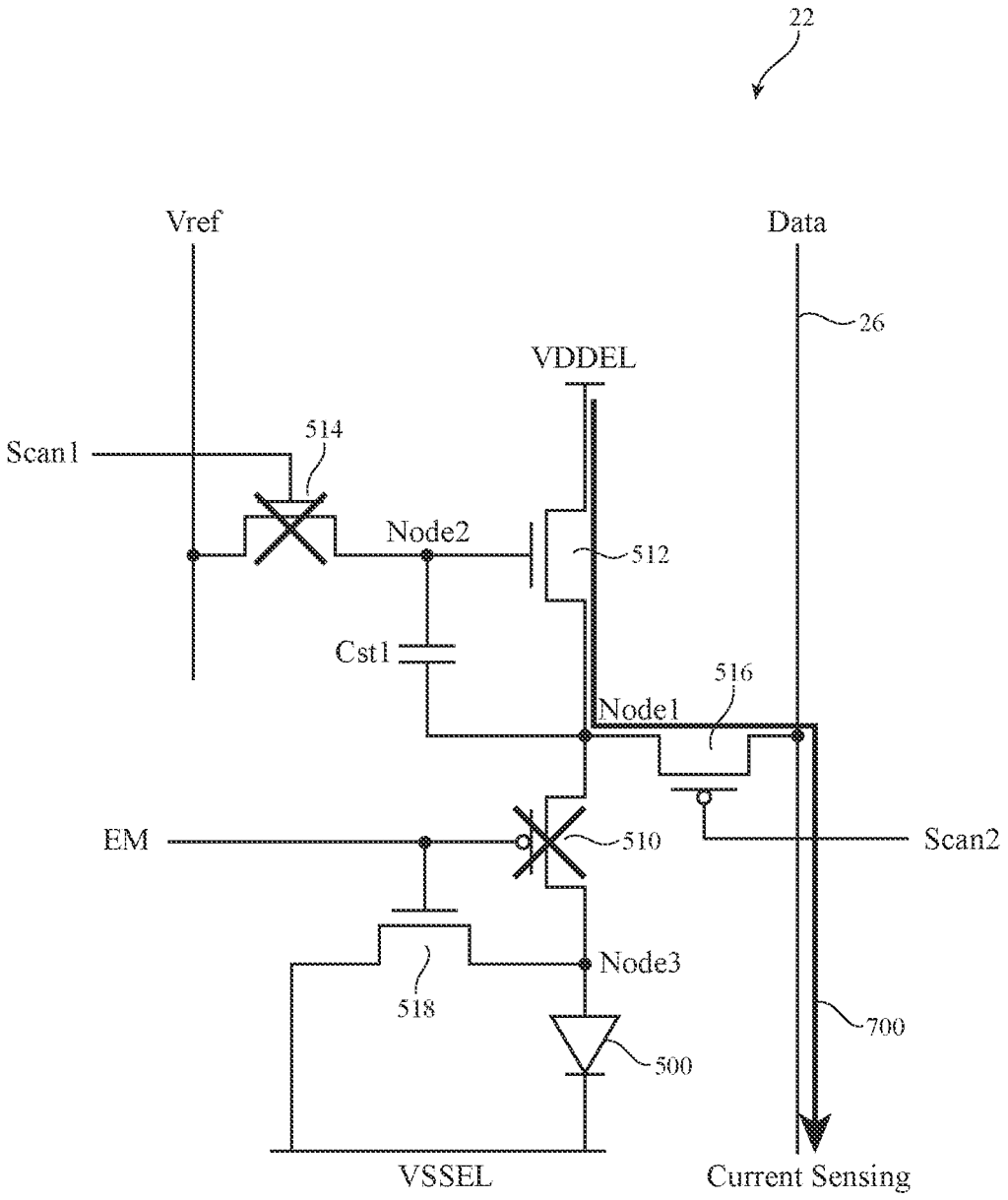
FIG. 7A is a circuit diagram illustrating the state of the display pixel of FIG. 5 during a current sensing phase in accordance with an embodiment.
Figure 7B:
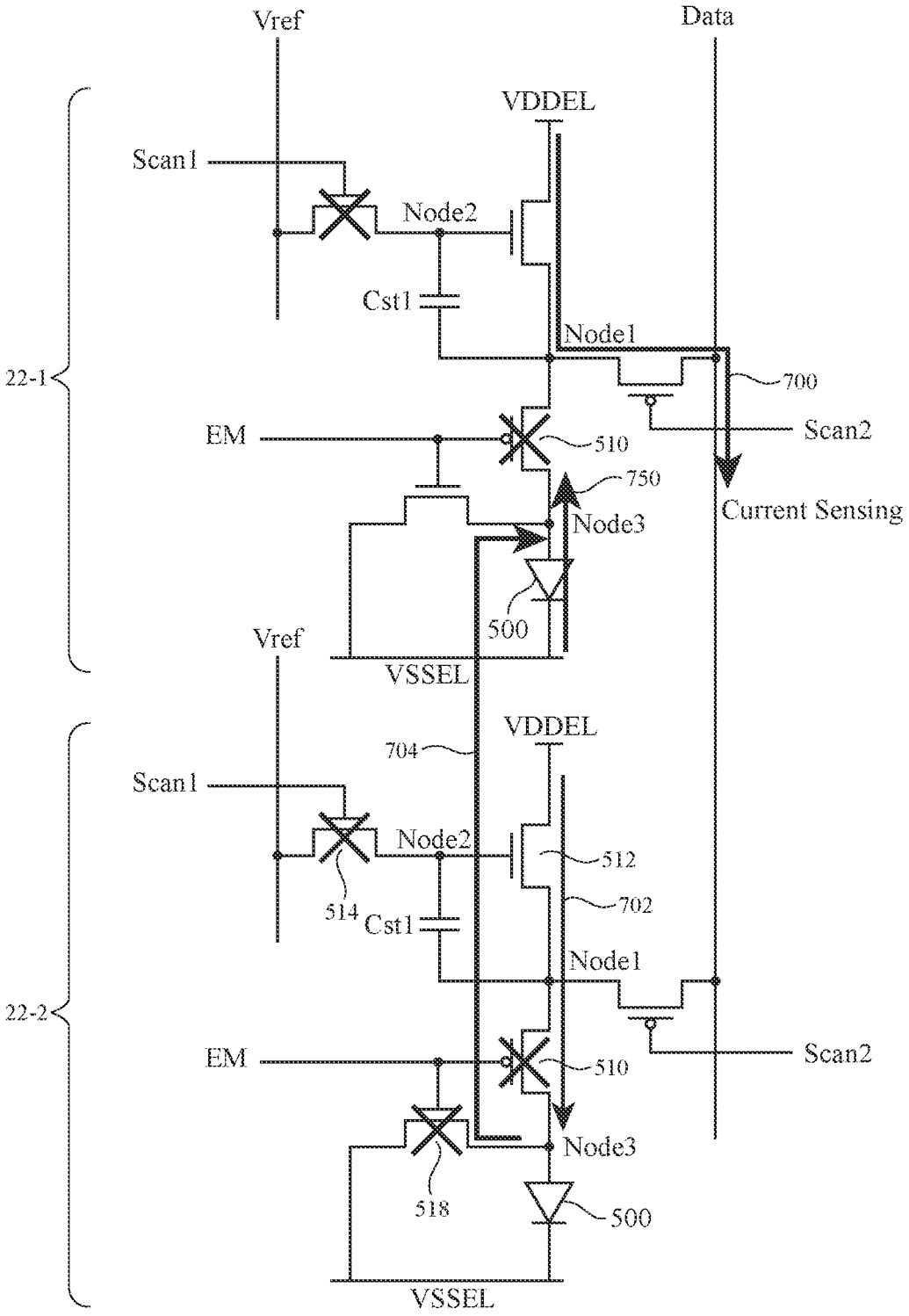
FIG. 7B is a circuit diagram illustrating how residue current and lateral leakage is mitigated during a current sensing phase in accordance with an embodiment.

FIG. 6 illustrates the normal driving scheme for driving data into even and odd display pixels. The configuration of pixel 22 during current sensing operations may be different than the driving scheme of FIG. 6 and is shown in FIGS. 7A and 7B. As shown in FIG. 7A, only signal SCAN2 is asserted (i.e., driven low) to turn on transistor 516 while signals SCAN1 and EM are deasserted (i.e., driven low) to turn off transistors 514 and 518. Operated in this way, current flowing through drive transistor 512 may be output from Node1 via transistor 516 onto data loading line 26, as indicated by current sensing path 700. The sensed current 700 may be fed to sense circuitry 25 (FIG. 2) and analyzed for external compensation.

The technical advantages and improvements to the operation of the display are illustrated in FIG. 7B. FIG. 7B shows an example in which current sensing is being performed on a first pixel 22-1 while a second adjacent pixel 22-2 is in the emission phase. Because transistor 510 in pixel 22-1 is turned off to decouple current sensing node Node1 from the anode terminal of diode 500, any residual current 750 from diode 500 cannot flow through transistor 510 to affect the amount of the sense current 700. Moreover, any lateral leakage current 704 flowing from the diode of adjacent pixel 22-2 also cannot flow through transistor 510 in pixel 22-1, thereby blocking any potential lateral leakage current from impacting the integrity of sensing current 700. As a result, the current sensed from pixel 22-1 will not experience any contribution from the residue current of diode 500 in pixel 22-1 nor will it experience any contribution from the lateral leakage current of diode 500 in an adjacent emitting pixel 22-2. Other undesired parasitic effects associated with diode 500 that can potentially impact the accuracy of the current sensing operation may also be eliminated.

Figure 8A:
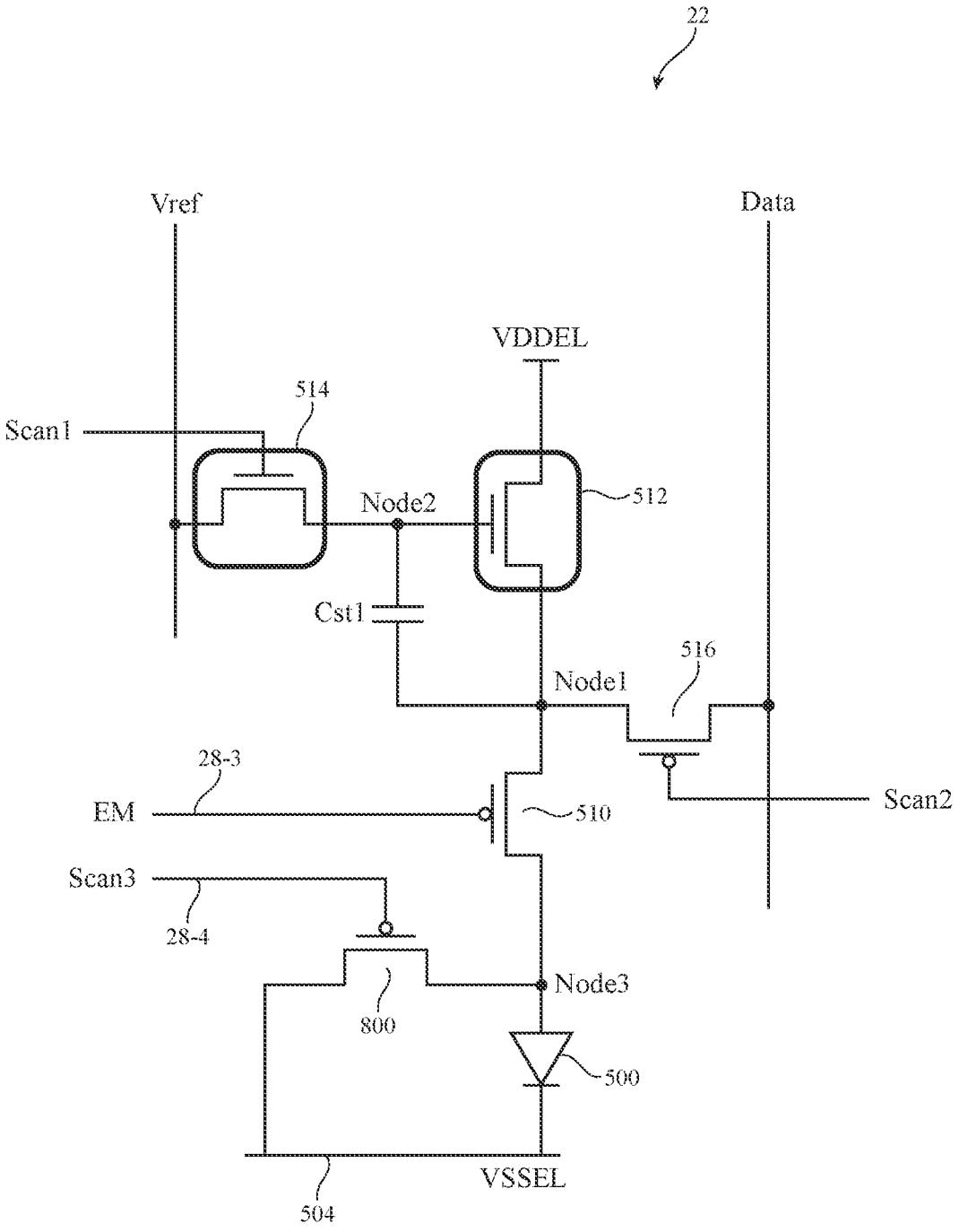
FIG. 8A is a circuit diagram of an illustrative display pixel in accordance with an embodiment.

FIG. 8A shows another suitable arrangement of display pixel 22 that mitigates diode current residue and lateral leakage current. As shown in FIG. 8A, display pixel 22 has a similar structure to that of FIG. 5, except the anode reset transistor 800 is controlled by a third scan control signal SCANS that is provided over a third scan control line 28-4. Having a different signal for controlling anode reset transistor 800 enables the anode reset operation to be performed separately. This may be advantageous to reduce power consumption for the display since the anode reset transistor does not have to be constantly turned on throughout the non-emission period.

In the example of FIG. 8A, transistor 512 and 514 may be semiconducting-oxide transistors, while the other transistors 510, 516, and 800 are silicon transistors (e.g., p-channel LTPS transistors). Since the impedance at the gate of drive transistor 512 is high, implementing drive transistor 512 and gate setting transistor 514 as semi-conducting oxide transistors is advantageous to help reduce leakage and power consumption. If desired, other combinations of silicon and/or oxide transistors can be used in the five-transistor configuration of FIG. 8A.

Figure 8B:
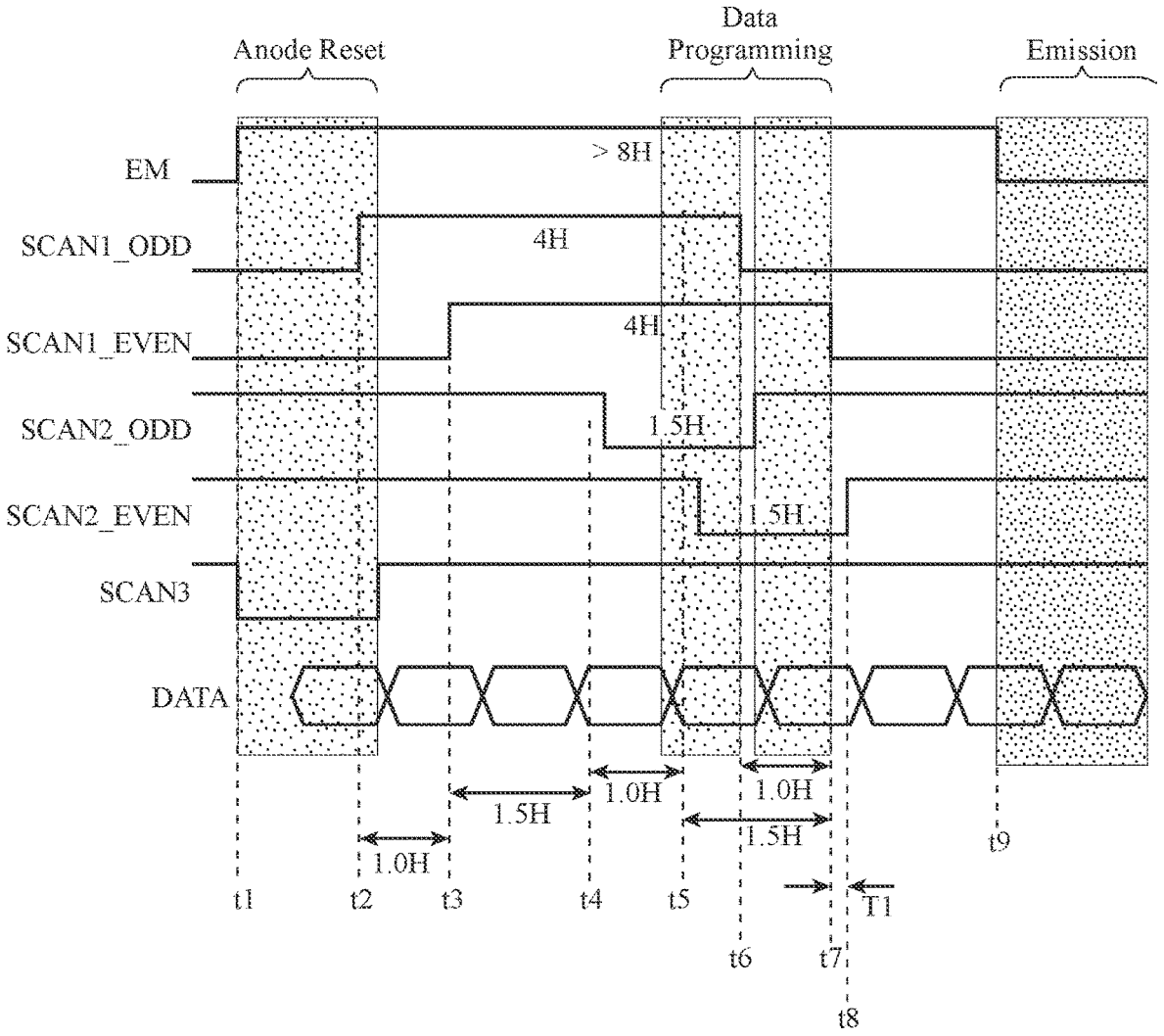
FIG. 8B is a timing diagram illustrating relevant waveforms for operating the display pixel shown in FIG. 8A in accordance with an embodiment.

FIG. 8B is a timing diagram illustrating relevant waveforms in operating display pixel 22 of FIG. 8A. In the example of FIG. 8B, signals EM and SCAN3 may be shared between even and odd rows, whereas signals SCAN1_ODD and SCAN2_ODD are separately fed to an odd row of pixels and while signals SCAN1_EVEN and SCAN2_EVEN are separately fed to an even row of pixels. Prior to time t1, only signal EM is asserted (e.g., active-low emission control signal EM is driven low to logic "0") while all other scan control signals are deasserted (e.g., the SCAN1 active-high signals are driven to logic "0", the SCAN2 active-low signals are driven to logic "1", and the SCAN3 active-low signal is also driven to logic "1"). The period during which signal EM is asserted may be referred to as the emission period or the emission phase.

At time t1, signal EM is deasserted to turn off emission control transistor 510. At time t1, signal SCAN3 is also asserted (i.e., driven low) to turn on anode reset transistor 800, thereby resetting anode terminal Node3 to ground voltage VSSEL. Signal SCAN3 may therefore sometimes be referred to as an anode reset control signal.

At time t2, anode reset control signal SCAN3 may be deasserted (i.e., driven back up high) and active-high scan signal SCAN1_ODD may be asserted to turn on transistor 514 in the odd row. Activating transistor 514 in the odd row may allow the gate of the corresponding drive transistor 512 to be set to the reference voltage level Vref. At time t3, scan signal SCAN1_EVEN may be asserted to turn on transistor 514 in the even row. Activating transistor 514 in the even row may allow the gate of the corresponding drive transistor 512 to be set to the reference voltage level Vref.

At time t4, active-low scan signal SCAN2_ODD may be asserted to turn on transistor 516 in the odd row. Activating transistor 516 in the odd row may allow a data signal supplied along line 26 to be loaded into the corresponding display pixel (e.g., the data signal may be loaded onto Node1). The value of the data signal at the falling edge of signal SCAN2_ODD (at around time t6) determines what is actually loaded into display pixel 22.

At time t5, active-low scan signal SCAN2_EVEN may be asserted to turn on transistor 516 in the even row. Activating transistor 516 in the even row may allow a data signal presented along line 26 to be loaded into the corresponding display pixel. The value of the data signal at the falling edge of signal SCAN2_EVEN (at around time t8) determines what is actually loaded into the display pixel.

Active-low signal SCAN2_ODD may be deasserted (i.e., driven high) right after time t6, which ends the data programming phase for the odd row. Active-low signal SCAN2_EVEN may be deasserted (i.e., driven high) at time t8, which ends the data programming phase for the even row. At time t9, signal EM is driven low to resume the emission period. During the emission phase, current will flow through transistors 510 and 512 and light-emitting diode 500, where the magnitude of the current is dependent on the voltage stored across capacitor Cst1. The amount of current will affect the actual luminance of light that is emitted from diode 500.

FIG. 8B illustrates the normal driving scheme for driving data into even and odd display pixels of the type shown in FIG. 8A. The illustrative display pixel structure of FIG. 8A also provides the same technical advantages (i.e., immunity to diode current residue and lateral current leakage) during current sensing operations.

Figure 9A:
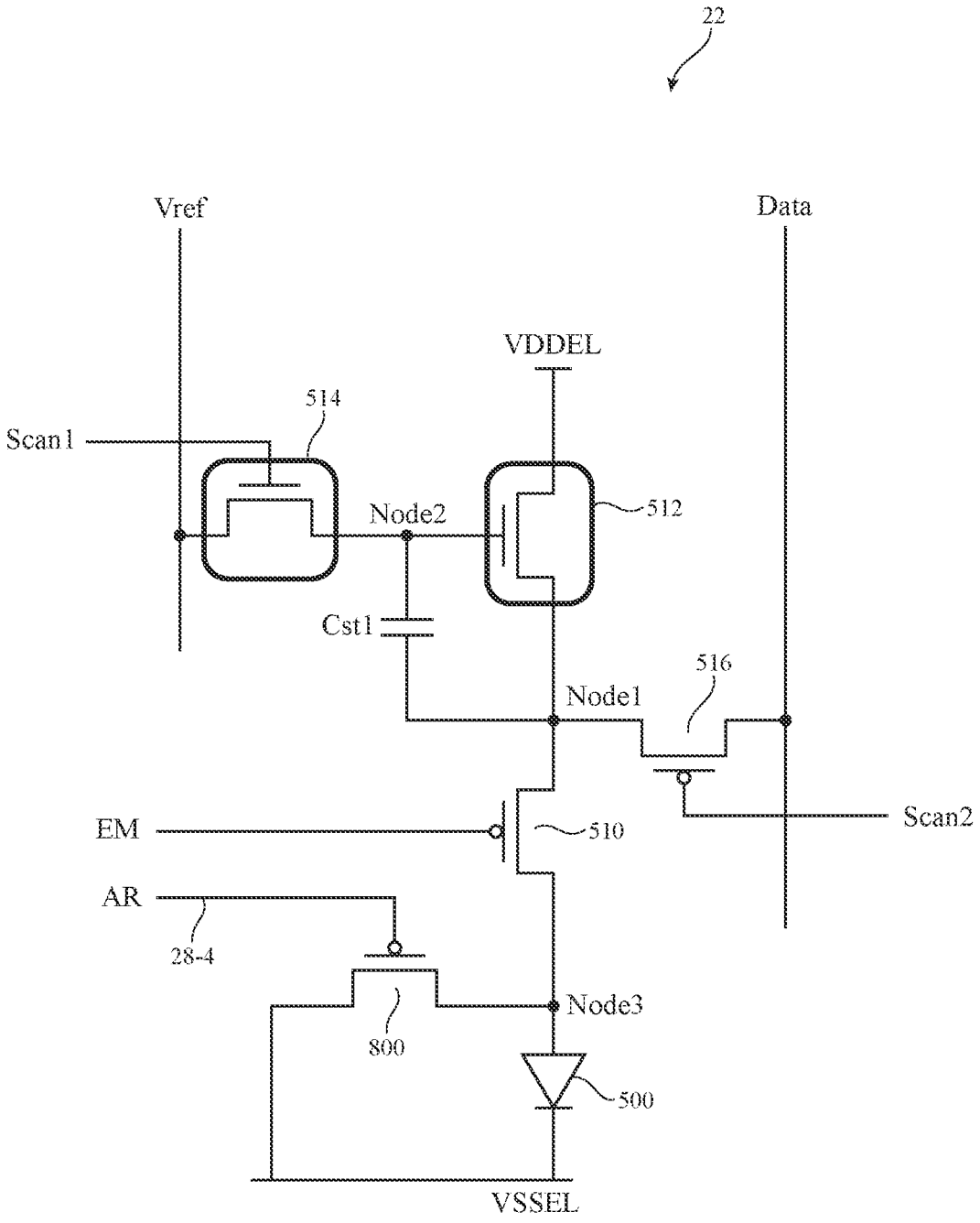
FIG. 9A is a circuit diagram of an illustrative display pixel in accordance with an embodiment.

FIG. 9A shows another suitable arrangement of display pixel 22 that mitigates diode current residue and lateral leakage current. As shown in FIG. 9A, display pixel 22 has a similar structure to that of FIG. 8A, except the anode reset transistor 800 is controlled by a anode reset control signal AR that is provided over anode reset control line 28-4. Having a different signal for controlling anode reset transistor 800 enables the anode reset operation to be performed separately. This may be advantageous to reduce power consumption for the display since the anode reset transistor does not have to be constantly turned on throughout the non-emission period.

In the example of FIG. 8A, transistor 512 and 514 may be semiconducting-oxide transistors, while the other transistors 510, 516, and 800 are silicon transistors (e.g., p-channel LTPS transistors). Since the impedance at the gate of drive transistor 512 is high, implementing drive transistor 512 and gate setting transistor 514 as semi-conducting oxide transistors is advantageous to help reduce leakage and power consumption. If desired, other combinations of silicon and/or oxide transistors can be used in the five-transistor configuration of FIG. 9A.

Figure 9B:
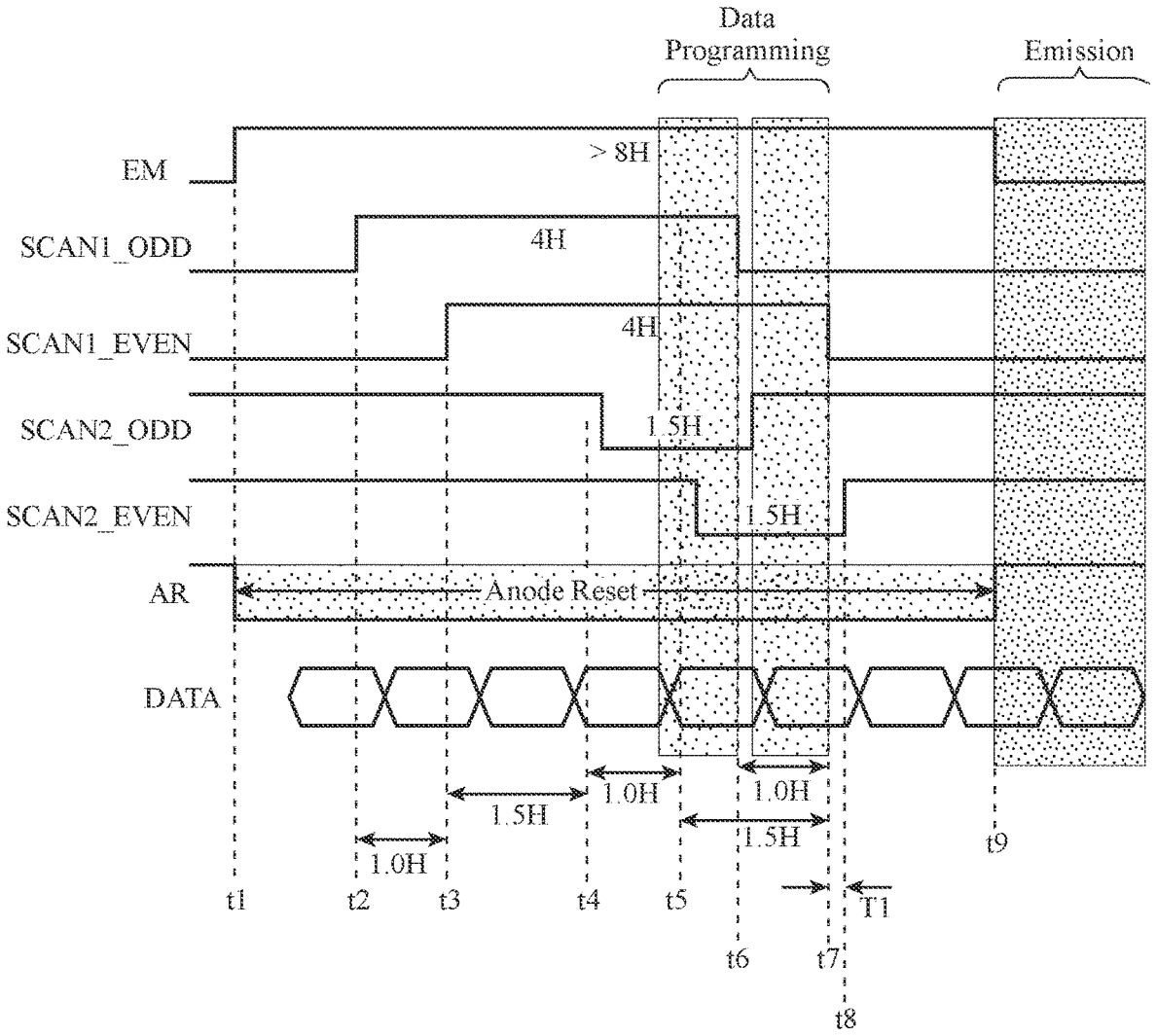
FIG. 9B is a timing diagram illustrating relevant waveforms for operating the display pixel shown in FIG. 9A in accordance with an embodiment.

FIG. 9B is a timing diagram illustrating relevant waveforms in operating display pixel 22 of FIG. 9A. In the example of FIG. 9B, signals EM and AR may be shared between even and odd rows, whereas signals SCAN1_ODD and SCAN2_ODD are separately fed to an odd row of pixels and while signals SCAN1_EVEN and SCAN2_EVEN are separately fed to an even row of pixels. Prior to time t1, only signal EM is asserted (e.g., active-low emission control signal EM is driven low to logic "0") while all other scan control signals are deasserted (e.g., the SCAN1 active-high signals are driven to logic "0", the SCAN2 active-low signals are driven to logic "1", and the AR active-low signal is also driven to logic "1"). The period during which signal EM is asserted may be referred to as the emission period or the emission phase.

At time t1, signal EM is deasserted to turn off emission control transistor 510. At time t1, signal AR is also asserted (i.e., driven low) to turn on anode reset transistor 800, thereby resetting anode terminal Node3 to ground voltage VSSEL. In contrast to the operation of FIG. 8B, anode reset transistor 800 may be left on until the emission period (e.g., signal AR may be asserted as long as the emission control signal EM is not asserted).

At time t2, active-high scan signal SCAN1_ODD may be asserted to turn on transistor 514 in the odd row. Activating transistor 514 in the odd row may allow the gate of the corresponding drive transistor 512 to be set to the reference voltage level Vref. At time t3, scan signal SCAN1_EVEN may be asserted to turn on transistor 514 in the even row. Activating transistor 514 in the even row may allow the gate of the corresponding drive transistor 512 to be set to the reference voltage level Vref.

At time t4, active-low scan signal SCAN2_ODD may be asserted to turn on transistor 516 in the odd row. Activating transistor 516 in the odd row may allow a data signal supplied along line 26 to be loaded into the corresponding display pixel (e.g., the data signal may be loaded onto Node1). The value of the data signal at the falling edge of signal SCAN2_ODD (at around time t6) determines what is actually loaded into display pixel 22.

At time t5, active-low scan signal SCAN2_EVEN may be asserted to turn on transistor 516 in the even row. Activating transistor 516 in the even row may allow a data signal presented along line 26 to be loaded into the corresponding display pixel. The value of the data signal at the falling edge of signal SCAN2_EVEN (at around time t8) determines what is actually loaded into the display pixel.

Active-low signal SCAN2_ODD may be deasserted (i.e., driven high) right after time t6, which ends the data programming phase for the odd row. Active-low signal SCAN2_EVEN may be deasserted (i.e., driven high) at time t8, which ends the data programming phase for the even row. At time t9, anode reset signal is deasserted and signal EM is driven low to resume the emission period. During the emission phase, current will flow through transistors 510 and 512 and light-emitting diode 500, where the magnitude of the current is dependent on the voltage stored across capacitor Cst1. The amount of current will affect the actual luminance of light that is emitted from diode 500.

FIG. 9B illustrates the normal driving scheme for driving data into even and odd display pixels of the type shown in FIG. 9A. The illustrative display pixel structure of FIG. 9A also provides the same technical advantages (i.e., immunity to diode current residue and lateral current leakage) during current sensing operations.

Figure 10:
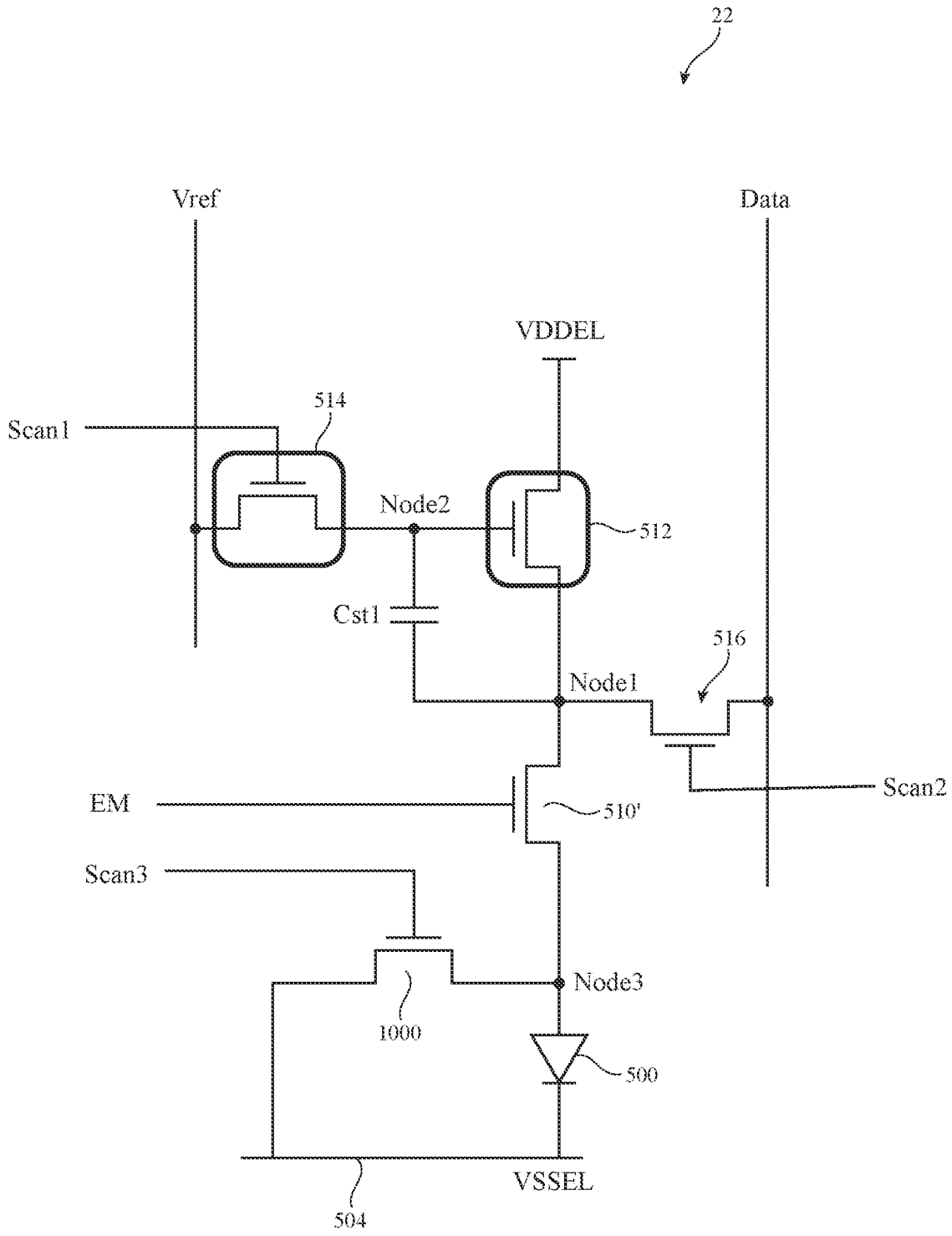
FIG. 10 is a circuit diagram of an illustrative display pixel in accordance with an embodiment.

FIG. 10 shows another yet suitable configuration of display pixel 22 that mitigates diode current residue and lateral leakage current. As shown in FIG. 10, display pixel 22 has a similar structure to that of FIG. 8, except the emission control transistor 510' and anode reset transistor 1000 are n-channel transistors controlled by active-high signals EM and SCANS, respectively. Similar to FIG. 8, having a different signal for controlling anode reset transistor 1000 enables the anode reset operation to be performed separately. This may be advantageous to reduce power consumption for the display since the anode reset transistor does not have to be constantly turned on throughout the non-emission period.

In the example of FIG. 10, transistor 512 and 514 may be semiconducting-oxide transistors, while the other transistors 510, 516, and 1000 are silicon transistors (i.e., n-channel silicon transistors). Since the impedance at the gate of drive transistor 512 is high, implementing drive transistor 512 and gate setting transistor 514 as semi-conducting oxide transistors is advantageous to help reduce leakage and power consumption. In another suitable arrangement, all five transistors in display pixel 22 of FIG. 10 may be semi-conducting oxide transistors. If desired, other combinations of silicon and/or oxide transistors can be used in the five-transistor configuration of FIG. 10.

Figure 11:
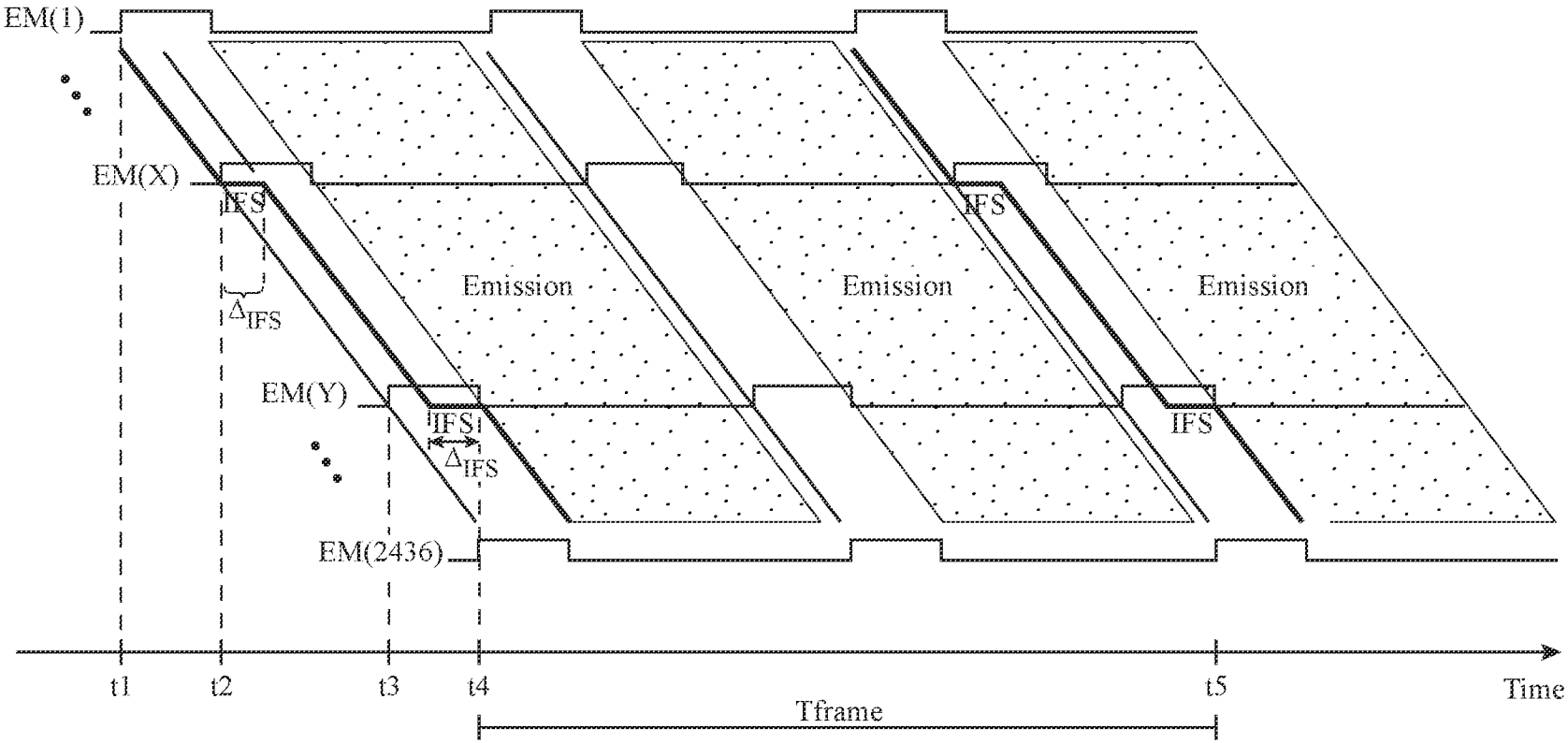
FIG. 11 is a timing diagram illustrating how a display of the type shown in connection with FIGS. 1-10 can be used to support in-frame sensing in accordance with an embodiment.

FIG. 11 is a timing diagram illustrating how a display of the type shown in connection with FIGS. 1-10 can be used to support in-frame sensing in accordance with an embodiment. In the example of FIG. 11, the emission control signals are shown as active-low signals (i.e., the display pixels are placed in the emission phase whenever the emission signal is driven low). As shown in FIG. 11, the emission control signals EM may be sequentially deasserted. For example, signal EM(1) for a first row may be deasserted to program data into the first row, signal EM(2) for a second row (not shown) may be deasserted to program data into the second row, etc.

In accordance with an embodiment, in-frame sensing (IFS) operations may be performed at selected rows in the display pixel array. In FIG. 11, a first IFS operation may be performed at time t2 for row X, and a second IFS operation may be performed at time t3 for row Y. The IFS operation may have a duration ΔIFS. The time period between time t4 and t5 may be the frame period Tframe.

Figure 12:
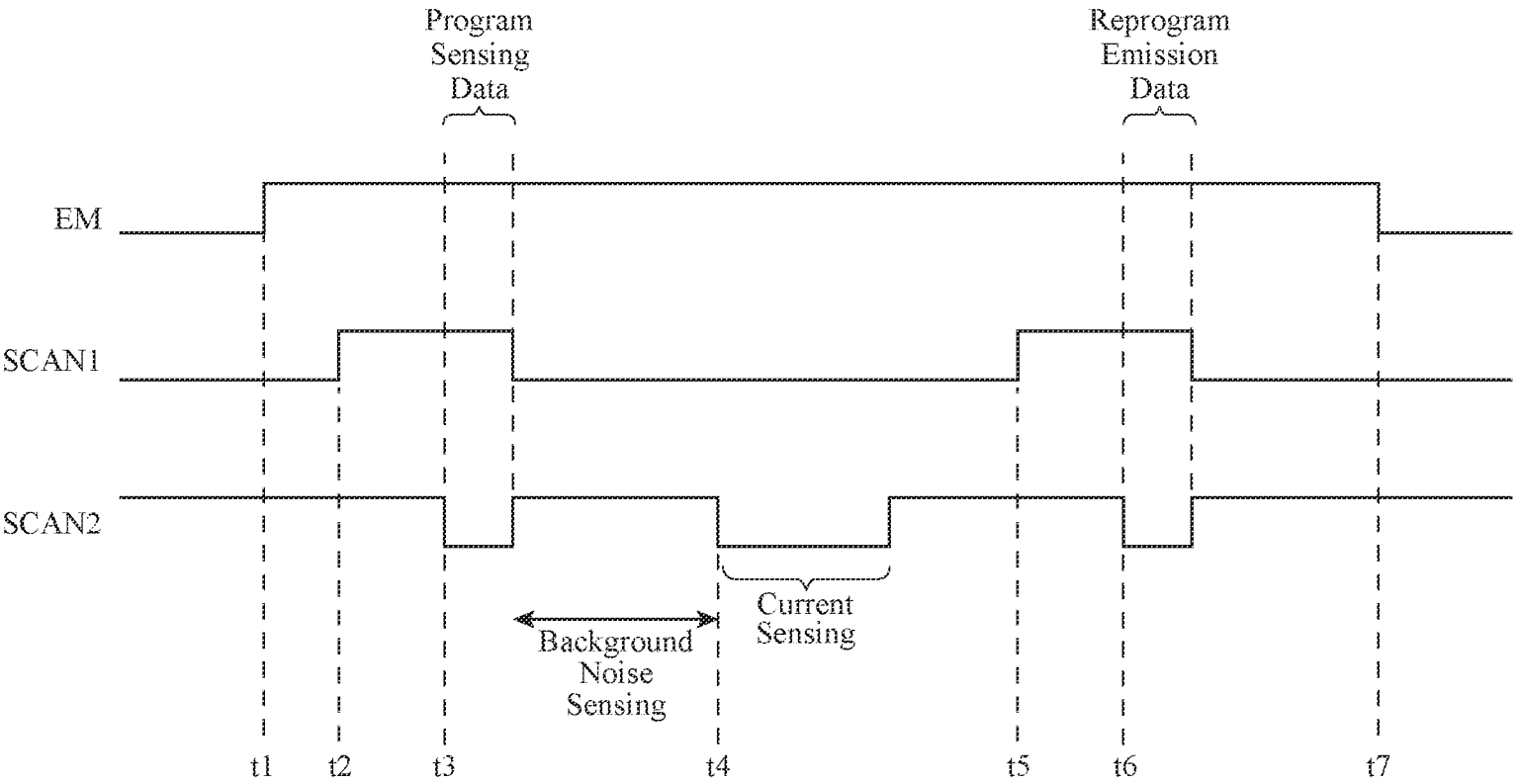
FIG. 12 is a timing diagram illustrating relevant waveforms during in-frame sensing operations in accordance with an embodiment.

FIG. 12 is a timing diagram illustrating relevant control signal waveforms for performing in-frame sensing operation on a display pixel of the type shown in connection with FIG. 5. At time t1, active-low emission control signal EM may be deasserted to temporarily pause the emission phase. At time t2, active-high signal SCAN1 may be pulsed high to temporarily turn on gate setting transistor 514 (i.e., to drive Node2 to reference voltage Vref). At time t3, active-low signal SCAN2 may be pulsed low to temporarily turn on data loading transistor 516. During this time, predetermined sensing data may be loaded into display pixel 22. After the predetermined sensing data has been loaded into pixel 22, signal SCAN1 may be driven low and sense circuitry 25 (FIG. 1) may be configured to sense the background noise (without turning on transistor 516).

At time t4, signal SCAN2 may be pulsed low to temporarily activate data-loading/current-sensing transistor 516. During this time, sense circuitry 25 may be configured to sense the actual current flowing through transistors 512 and 516 and onto sensing line 26 (as indicated by the current sensing path 700 shown in FIG. 7A). The sensing current may be compared with the background noise to derive an accurate reading that is used for external compensation.

At time t5, active-high signal SCAN1 may again be pulsed high to temporarily turn on gate setting transistor 514 (i.e., to drive Node2 to reference voltage Vref). At time t6, active-low signal SCAN2 may again be pulsed low to temporarily turn on data loading transistor 516. During this time, the desired emission data may be loaded into display pixel 22. After the reprogramming pixel 22 with the actual image data, signal SCAN1 may be driven low. At time t7, active-low emission signal EM is asserted (i.e., driven low) to restart the emission phase.

The in-frame sensing operation shown in FIG. 12 is merely illustrative. If desired, other ways of performing in-frame sensing may be implemented. For example, the principles of FIG. 12 may be extended and applied to display pixels with any number of scan control signals, shared emission control signals, any number of n-channel or p-channel transistors, etc. The exemplary pixel architectures shown in FIGS. 5, 8, and 10 that include five transistors, one capacitor, one emission control line, and various scan control lines are merely illustrative. If desired, the techniques described herein may be extended or applied to pixel structures that include any number of oxide or silicon transistors, any number of capacitors, more than one emission line, less than three scan control lines or more than three scan control lines, and other suitable display pixel architectures.

In accordance with an embodiment, a display pixel is provided that includes an organic light-emitting diode, a drive transistor coupled in series with the organic light-emitting diode, the drive transistor has a drain terminal, a gate terminal, and a source terminal, a data line, a data loading transistor coupled between the data line and the source terminal of the drive transistor, the data loading transistor is configured to write data from the data line into the display pixel during data loading operations and to output sensing current onto the data line during current sensing operations, and an emission control transistor interposed between the drive transistor and the organic light-emitting diode, the emission control transistor is configured to decouple the organic light-emitting diode from the drive transistor during the current sensing operations.

In accordance with another embodiment, the emission control transistor is turned off during the current sensing operations to prevent residue current and lateral leakage current at the organic light-emitting diode from contributing to the sensing current.

In accordance with another embodiment, the display pixel includes a gate setting transistor coupled to the gate terminal of the drive transistor, the gate setting transistor is configured to provide a reference voltage onto the gate terminal of the drive transistor.

In accordance with another embodiment, the display pixel includes a storage capacitor having a first terminal coupled to the gate terminal of the drive transistor and a second terminal coupled to the source terminal of the drive transistor.

In accordance with another embodiment, the display pixel includes an anode resetting transistor coupled in parallel with the organic light-emitting diode.

In accordance with another embodiment, the emission control transistor has a gate terminal configured to receive an emission control signal, and the anode resetting transistor has a gate terminal configured to receive the emission control signal.

In accordance with another embodiment, the emission control transistor has a gate terminal configured to receive an emission control signal, and the anode resetting transistor has a gate terminal configured to a scan control signal that is different than the emission control signal.

In accordance with another embodiment, the emission control signal and the scan control signal are shared between at least two adjacent rows of display pixels.

In accordance with another embodiment, the drive transistor and the gate setting transistor are semi-conducting oxide transistors, and at least one other transistor in the display pixel is not a semi-conducting oxide transistor.

In accordance with another embodiment, all of the transistors in the display pixel are semi-conducting oxide transistors.

In accordance with an embodiment, a method of operating a display pixel is provided that includes a drive transistor, an emission control transistor, and an organic light-emitting diode couple in series, the method includes turning off the emission control transistor to decouple the drive transistor from the organic light-emitting diode, and while the emission control transistor is turned off, turning on a data loading transistor to output sensing current onto a corresponding data line, the sensing current flows through the drive transistor, and the emission control transistor prevents residue current and lateral leakage current at the organic light-emitting diode from contributing to the sensing current.

In accordance with another embodiment, the method includes turning on an anode reset transistor to reset the organic light-emitting diode.

In accordance with another embodiment, the method includes providing an emission control signal to control both the emission control transistor and the anode reset transistor.

In accordance with another embodiment, the method includes providing an emission control signal to the emission control transistor, and providing a scan control signal to the anode reset transistor, the emission control signal and the scan control signal are different.

In accordance with another embodiment, the method includes using the data loading transistor to program sensing data into the display pixel, sensing background noise from the display pixel while the data loading transistor is turned off, and after outputting the sensing current onto the data line, using the data loading transistor to program the display pixel with emission data, the emission data is different than the sensing data.

In accordance with an embodiment, display circuitry is provided that includes compensation circuitry configured to compensate for variations within the display circuitry and a display pixel that includes a drive transistor having a drain terminal, a gate terminal, and a source terminal a data loading transistor coupled to the source terminal of the drive transistor, the data loading transistor is configured to output a sensing current from the drive transistor to the compensation circuitry an organic light-emitting diode coupled in series with the drive transistor and an emission control transistor coupled between the drive transistor and the organic light-emitting diode, the emission control transistor is configured to electrically isolate the organic light-emitting diode from the data loading transistor while the data loading transistor is outputting the sensing current to the compensation circuitry.

In accordance with another embodiment, the display circuitry includes an additional display pixel that includes an additional emission control transistor and an additional data loading transistor, the emission control transistor and the additional emission control transistor receive the same emission control signal, and the data loading transistor and the additional data loading transistor receive different scan control signals.

In accordance with another embodiment, the drive transistor in the display pixel is implemented as a semi-conducting oxide transistor to reduce leakage current, and at least one other transistor in the display pixel is implemented as a silicon transistor to increase performance.

In accordance with another embodiment, the data loading transistor is turned off while the compensation circuitry is configured to sense background noise, and the compensation circuitry is further configured to compare the sensing current to the background noise.

In accordance with another embodiment, the data loading transistor is configured to reprogram emission data into the display pixel after sensing the background noise.

The foregoing is merely illustrative and various modifications can be made by those skilled in the art without departing from the scope and spirit of the described embodiments. The foregoing embodiments may be implemented individually or in any combination.

What is claimed is:

1. A display pixel, comprising:

an organic light-emitting diode;

a drive transistor coupled in series with the organic light-emitting diode, wherein the drive transistor has a drain terminal, a gate terminal, and a source terminal;

a data line;

a data loading transistor coupled between the data line and the source terminal of the drive transistor, wherein the data loading transistor is configured to write data from the data line into the display pixel during data loading operations and to output sensing current onto the data line during current sensing operations; and an emission control transistor interposed between the drive transistor and the organic light-emitting diode, wherein the emission control transistor is configured to decouple the organic light-emitting diode from the drive transistor during the current sensing operations.

2. The display pixel of claim 1, wherein the emission control transistor is turned off during the current sensing operations to prevent residue current and lateral leakage current at the organic light-emitting diode from contributing to the sensing current.

3. The display pixel of claim 1, further comprising a gate setting transistor coupled to the gate terminal of the drive transistor, wherein the gate setting transistor is configured to provide a reference voltage onto the gate terminal of the drive transistor.

4. The display pixel of claim 3, further comprising a storage capacitor having a first terminal coupled to the gate terminal of the drive transistor and a second terminal coupled to the source terminal of the drive transistor.

5. The display pixel of claim 4, further comprising an anode resetting transistor coupled in parallel with the organic light-emitting diode.

6. The display pixel of claim 5, wherein the emission control transistor has a gate terminal configured to receive an emission control signal, and wherein the anode resetting transistor has a gate terminal configured to receive the emission control signal.

7. The display pixel of claim 5, wherein the emission control transistor has a gate terminal configured to receive an emission control signal, and wherein the anode resetting transistor has a gate terminal configured to receive an additional control signal that is different than the emission control signal.

8. The display pixel of claim 7, wherein the emission control signal and the additional control signal are shared between at least two adjacent rows of display pixels.

9. The display pixel of claim 5, wherein the drive transistor and the gate setting transistor are semi-conducting oxide transistors, and wherein at least one other transistor in the display pixel is not a semi-conducting oxide transistor.

10. The display pixel of claim 5, wherein all of the transistors in the display pixel are semi-conducting oxide transistors.

11. A method of operating a display pixel that comprises a drive transistor, an emission control transistor, and an organic light-emitting diode couple in series, the method comprising:

turning off the emission control transistor to decouple the drive transistor from the organic light-emitting diode; and while the emission control transistor is turned off, turning on a data loading transistor to output sensing current onto a corresponding data line, the sensing current flows through the drive transistor, and the emission control transistor prevents residue current and lateral leakage current at the organic light-emitting diode from contributing to the sensing current.

12. The method of claim 11, further comprising turning on an anode reset transistor to reset the organic light-emitting diode.

13. The method of claim 12, further comprising providing an emission control signal to control both the emission control transistor and the anode reset transistor.

14. The method of claim 12, further comprising:

providing an emission control signal to the emission control transistor; and providing an additional control signal to the anode reset transistor, wherein the emission control signal and the additional control signal are different.

15. The method of claim 12, further comprising:

using the data loading transistor to program sensing data into the display pixel;

sensing background noise from the display pixel while the data loading transistor is turned off; and after outputting the sensing current onto the data line, using the data loading transistor to program the display pixel with emission data, wherein the emission data is different than the sensing data.

16. Display circuitry, comprising:

compensation circuitry configured to compensate for variations within the display circuitry; and a display pixel that comprises:

a drive transistor having a drain terminal, a gate terminal, and a source terminal;

a data loading transistor coupled to the source terminal of the drive transistor, wherein the data loading transistor is configured to output a sensing current from the drive transistor to the compensation circuitry;

an organic light-emitting diode coupled in series with the drive transistor; and an emission control transistor coupled between the drive transistor and the organic light-emitting diode, wherein the emission control transistor is configured to electrically isolate the organic light-emitting diode from the data loading transistor while the data loading transistor is outputting the sensing current to the compensation circuitry.

17. The display circuitry of claim 16, further comprising an additional display pixel that includes an additional emission control transistor and an additional data loading transistor, wherein the emission control transistor and the additional emission control transistor receive the same emission control signal, and wherein the data loading transistor and the additional data loading transistor receive different scan control signals.

18. The display circuitry of claim 16, wherein the drive transistor in the display pixel is implemented as a semi-conducting oxide transistor to reduce leakage current, and wherein at least one other transistor in the display pixel is implemented as a silicon transistor to increase performance.

19. The display circuitry of claim 16, wherein the data loading transistor is turned off while the compensation circuitry is configured to sense background noise, and wherein the compensation circuitry is further configured to compare the sensing current to the background noise.

20. The display circuitry of claim 19, wherein the data loading transistor is configured to reprogram emission data into the display pixel after sensing the background noise.

* * * * *